US012564226B2

(12) United States Patent
Zodel et al.

(10) Patent No.: US 12,564,226 B2
(45) **Date of Patent: *Mar. 3, 2026**

(54) INFANT-NURSING SAFETY GARMENT

(71) Applicant: Fashion Institute of Technology, New York, NY (US)

(72) Inventors: Lauren Zodel, New York, NY (US); Barbara Seggio, New York, NY (US)

(73) Assignee: Fashion Institute of Technology, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/660,900

(22) Filed: May 10, 2024

(65) Prior Publication Data

US 2024/0292914 A1 Sep. 5, 2024

Related U.S. Application Data

(63) Continuation of application No. 17/498,467, filed on Oct. 11, 2021, now Pat. No. 12,011,051, which is a (Continued)

(51) Int. Cl.
*A41D 1/215* (2018.01)
*A41D 1/21* (2018.01)

(52) U.S. Cl.
CPC ..... *A41D 1/215* (2018.01); *A41D 1/21* (2018.01); *A41D 2400/482* (2013.01)

(58) Field of Classification Search
CPC . A41D 1/21; A41D 1/215; A41D 1/22; A41D 2400/482; A41D 1/18; A41D 15/04; (Continued)

(56) References Cited

U.S. PATENT DOCUMENTS 2,228,234 A 1/1941 Mott
4,166,558 A 9/1979 Schroeder
(Continued)

FOREIGN PATENT DOCUMENTS

CA 2770425 8/2013
CA 2910790 5/2017
(Continued)

OTHER PUBLICATIONS

Web Article: "Breastfeeding Nursing Cover, Trcoveric Lightweight Breathable 100% Cotton Privacy Feeding Cover, Nursing Apron for Breastfeeding", [online] Amazon 2017, [Retrieved in 2019] Retrieved from https://www.etsy.com/iisting/513487098/eve.ryday-wrap-by-be.achfront-baby?gpla=1 &gao=l&&ut. ? source=google&utm meclium=cpc&utm campaign=shopping us a-accessories-baby accessories-baby carriers ancl wraps&utm customl? 157dle05-8cfa-4e6c-90c7? ea9c81fc7f32&utm content=go 1844702565 70025064392.
(Continued)

*Primary Examiner* — Amy Vanatta
(74) *Attorney, Agent, or Firm* — Fox Rothschild LLP

(57) ABSTRACT

The present invention relates to an article of clothing that is worn by a person for preventing an infant from accidental falling while the person nurses the infant. The article may be a garment that includes an item of clothing to be worn by a person and a support garment panel attached to the item of clothing. The support garment panel is attached to the perimeter of the armholes of the item of clothing and defines a pocket between the support garment panel and the item of clothing. The pocket includes an opening for receiving an infant and a base for supporting the infant.

9 Claims, 9 Drawing Sheets

Related U.S. Application Data continuation of application No. 16/675,142, filed on Nov. 5, 2019, now Pat. No. 11,140,930, which is a continuation of application No. 16/205,147, filed on Nov. 29, 2018, now Pat. No. 10,477,904.

(60) Provisional application No. 62/636,098, filed on Feb. 27, 2018.

(58) Field of Classification Search

CPC . A41D 15/00; A41D 3/08; A41D 1/04; A41B 1/18; A41B 1/22; A41B 1/02; A41B 1/08; A41B 13/06; A41B 13/065; A41B 13/00; A41C 3/04; A47D 13/02; A47D 13/025; A47D 13/029

USPC ..... 2/104; 224/158, 159, 160

See application file for complete search history.

(56) References Cited

U.S. PATENT DOCUMENTS

| | | | |
|---|---|---|---|
| 4,579,264 | A | 4/1986 | Napolitano |
| 4,757,925 | A | 7/1988 | Knittel |
| 5,592,692 | A | 1/1997 | Larson |
| 5,946,725 | A | 9/1999 | Shatzkin et al. |
| 6,213,362 | B1 | 4/2001 | Lorenzini |
| 6,216,272 | B1 | 4/2001 | Rosengren et al. |
| 6,343,727 | B1 | 2/2002 | Leach |
| 6,398,088 | B1 | 6/2002 | Burke |
| 6,855,029 | B2 | 2/2005 | Rothman |
| 7,114,191 | B1 | 10/2006 | Butler-Penenberg |
| 7,188,372 | B2 | 3/2007 | Stockard |
| 7,296,303 | B1 | 11/2007 | Samet |
| 7,765,613 | B2 | 8/2010 | Carr |
| D691,791 | S | 10/2013 | Rondone |
| 8,561,861 | B2 | 10/2013 | Muehlen |
| 8,973,793 | B2 | 3/2015 | Arvan |
| D778,029 | S | 2/2017 | Simmer et al. |
| 9,775,446 | B2 | 10/2017 | Simmer et al. |
| 2004/0139526 | A1 | 7/2004 | Davis |
| 2004/0143885 | A1 | 7/2004 | Rothman |
| 2004/0166766 | A1 | 8/2004 | Schneider |
| 2006/0005294 | A1 | 1/2006 | Fugazzi |
| 2007/0074330 | A1 | 4/2007 | Azaronak |
| 2007/0271675 | A1 | 11/2007 | Eraca |
| 2008/0022434 | A1 | 1/2008 | Adelman |
| 2008/0034464 | A1 | 2/2008 | Jensen |
| 2009/0265830 | A1 | 10/2009 | Hendrickson |
| 2011/0079622 | A1 | 4/2011 | Muehlen |
| 2012/0234877 | A1 | 9/2012 | Hiniduma-Lokuge |
| 2013/0200116 | A1 | 8/2013 | Arvan |
| 2013/0269082 | A1 | 10/2013 | Bramblet |
| 2013/0291279 | A1 | 11/2013 | Jensen et al. |
| 2014/0197214 | A1 | 7/2014 | Simmer et al. |
| 2014/0220860 | A1 | 8/2014 | Alva |
| 2014/0259277 | A1 | 9/2014 | Herschorn |
| 2014/0273737 | A1 | 9/2014 | Cortese et al. |
| 2015/0089710 | A1 | 4/2015 | Halverstadt et al. |
| 2016/0120333 | A1 | 5/2016 | Brandner et al. |
| 2016/0198865 | A1 | 7/2016 | Houston |
| 2016/0206011 | A1 | 7/2016 | Houston |
| 2016/0302587 | A1 | 10/2016 | Simmer et al. |
| 2017/0196284 | A1 | 7/2017 | Hamidi |
| 2018/0000168 | A1 | 1/2018 | Alva |
| 2019/0075936 | A1 | 3/2019 | Salazar et al. |

FOREIGN PATENT DOCUMENTS

| | | | | |
|---|---|---|---|---|
| KR | 20090004700 U | * | 5/2009 | |
| WO | 2009081400 | | 7/2009 | |
| WO | WO-2009081400 A2 | * | 7/2009 | ..... A41D 1/205 |
| WO | 2011119070 | | 9/2011 | |
| WO | 2015127514 | | 9/2015 | |

OTHER PUBLICATIONS

Web Article: "Baby Tula Ring Slings", [online] Baby Tula 2017, [Retrieved in 2019] Retrieved from https://babytula.com/collections/ring-slings.

Web Article "Lullaby Baby Wraps Carrier, Perfect for Babies from 4 Months Up to 35 lbs (4-36 Months) by Lullaby", [online] Amazon 2017, [Retrieved in 2019] Retrieved from https://www.amazon.com/Lullaby-Carrier-Perfect-8abies-Months/dp/B07L8X8L3X/ref=asc df 8O7L8XBL3Xi? tag=hyprod- 20&1inkCode""dfO &hvadid""343985575567&hvpos==lo5&hvnetw=g&hvrand=13716342'78194581114'7&1ivpone==&livptwo""&hvqmt=&livdev=c&livdvcmdl=&hv! ocint=&hvlocpliy=9007 442&1ivtargid=pla-747 369985836.

Web Article: "Sleeveless Mei Tai Wrap T-Shirt & Nursing Sliirt (Medium, Black/Sand) by Mommy Paradise", [online] Amazon 2017, [Retrieved in 2019] Retrieved from https://www.amazon.com/Sleeveless-T-Shirt-Nursing-Shirt-Medium/dp/BOOH7MY1YA.

Web Article: "Sola Cradle Sling Orange by Sola", [online] Amazon 2017, [Retrieved in 2019] Retrieved from https://www.amazon.com/Sola-A-0031-Cradle-Sling-Orange/dp/B00VV7YXZY.

Web Article: "Biubee Water Sling Baby Wrap Carrier—Adjustable Shoulder Ring Mesh Breathable Chest Sling Infant Carrier for Summer Pool", [online] Amazon 2017, [Retrieved in 2019] Retrieved from https://www.amazon.com/Biubee-Water-Sling-Baby-Carrier/dp/B01 JHQ5Bllittps://www.amazon.com/Biubee-Water-Sling-Baby-Carrier/dp/B01JHQSBIS.

Web Article: "Leachco Natural Boost—Adjustable Nursing Pillow—Denim : Breast Feeding Pillows", [online] Amazon 2017, [Retrieved in 2019] Retrieved from https://www.amazon.com/Leachco-Natural-Boost-Adjustable-Nursing/dpiB00080LZVA.

Web Article "Moby Classic Warp Baby Carrier", [online] Target 2017, [Retrieved in 2019] Retrieved from https://www.target.com/pimoby-wrap-classic-mist-baby-carrier-blue/-/A-52865030?ref=tgt_adv_XSOOOOOO&AFID=google_pla_df&fndsrc=tgtao&CPNG=PLA_Baby %2BShopping&adgroup=SC_Baby&LID=700000001170770pgs network=g&device= c&location=9007442&ds_rl=1246978&ds_rl=1248099&ds_rl=1241788&gclid=CO206tfd2u ICFda FswodTKwM-g&gclsrc=aw.ds.

Web Article "Hotslings AP Adjustable Pouch Sling: Slings & Wraps: Carriers: Travel: CanaBee Baby", [online] babyramacanada 2017, [Retrieved in 2019] Retrieved from http://ba byramacanada.com/xcart/Hotslings-AP-Adjustable-Pouch-Sling.html.

Web Article: "Baba Sling Standard, Baba Sling allows you to carry your baby in the following 5 positions:" [online] Baba Slings® Standard 2017, [Retrieved in 2019] Retrieved from http://www.babaslings.com/shop/standard.

Web Article : "Vija Design Kangaroo Top Halter Strap", [online] Milk & Baby 2017, [Retrieved in 2019] Retrieved from https ://www.milkandbaby. corn/products/halter-strap-kangaroo-tube-coral?variant= 19106193932357.

Web Article: "Items similar to Everyday Wrap by Beachfront Baby—Recycled knit baby wrap", [online] ETSY.corn 2017, [Retrieved in 2019] Retrieved from https //www.etsy.com/listing /513487098/everyday-wrap-by-be.achfront-baby?g pla=1&gao=l&&ut .? source=google &utm medium=cpc&utm campaign=shopping us a-accessories-baby accessories-baby carriers and wraps&utmcustoml?157dle05-8cfa-4e6c-90c7?ea9c81fc7f32&utrn content=go 1844 702565.

Web Article: "Lalabu Soothe Shirt® Simple Gray" , [online] shop.lalabu.com 2017, [Retrieved in 2019] Retrieved from https://shop.lalabu .corn/products/new-soothe-shirt-simple-gray? variant=28555712199&cu rrency=USD&gclid=CKiCw_Lf2ulCFcSAnwod EHkFlw.

Web Article: "Vija Design Skin To Skin Kangaroo T-Shirt & Nursing Top" [online] Milk & Baby 2017, [Retrieved in 2019] Retrieved from https://www.milkandbaby.com/products/skin-to-skin-kangaroo-t-shirt-nursing-top-lagoon-blue?variant=19114753196101.

Web Article: "Imagine Kangaroo Care Dad Shirt Baby Wrap T-Shirt Baby Carrier Wrap Tank Shirt", [online] Amazon 2017, [Retrieved in 2019] Retrieved from https://www.amazon.com/Imagine-Kangaroo-Shirt-T-Shirt-Carrier/dp/B076RW4B54?th=1.

(56) References Cited

OTHER PUBLICATIONS

Web Article "Justin's Experience—a father at caesarean", [online] 2018 Kangaroo Mother Care, [Retrieved in 2019] Retrieved from http://www.kangaroomothercare.com/justins-experience.axpx.
Web Article: "Boba Baby Wrap Grey—The Original Child and Newborn Wrap, Perfect for Infants and Babies Up to 35 lbs: Child Carrier" [online] Amazon 2017, [Retrieved in 2019] Retrieved from https://www.amazon.com/Boba-Baby-Wrap-Carrier-Grey/dp/B005SP2LVWJ ref=asc_df_B005SP2LWWWWV/? tag=hyprod-20 &1inkCode=dfO&hvadid=198077878230&hvpos=101&hvnetw=g &hvrand=5708181906065048236&hvine=&hvptwo=&hvqmt= &hvdev=c&hvdvcmdl=&hvlocint=&hvlocphy=9060351 &hvtargid= pia-339171899201 &th=1.

* cited by examiner

INFANT-NURSING SAFETY GARMENT

RELATED APPLICATIONS

This application is a continuation of U.S. application Ser. No. 17/498,467, filed Oct. 11, 2021, which is a continuation of U.S. application Ser. No. 16/675,142, filed Nov. 5, 2019, now U.S. Pat. No. 11,140,930, issued Oct. 12, 2021, which is a continuation of U.S. application Ser. No. 16/205,147, filed Nov. 29, 2018, now U.S. Pat. No. 10,477,904, issued Nov. 19, 2019, which claims the benefit of priority to U.S. Provisional Patent Application No. 62/636,098, filed Feb. 27, 2018, each of these applications is incorporated by reference herein in their entirety.

FIELD OF THE INVENTION

The present invention relates generally to an article of clothing, and more particularly, to an article of clothing which is worn by a person for preventing an infant from accidentally falling.

BACKGROUND OF THE INVENTION

There are currently a significant number of injuries or deaths arising from caregivers who accidently allow a baby to fall while under their care such as during nursing or bottle feeding. These types of accident can occur due to a caregiver being too tired and falling asleep while they are holding the child. The injury suffered from a fall can have serious consequences. There are various products on the market that are adapted to be infant carriers, but some potential deficiencies with these products can relate to the position of the child in the product and the risk of suffocation. Accordingly, there is a need for a garment that can facilitate nursing and prevent an infant from accidental falls.

SUMMARY OF THE INVENTION

In accordance with principles of the present invention, an apparel is provided that is adapted to provide a safety mechanism that supports an infant when an event occurs such as a caregiver falling asleep when holding the infant during nursing. Various embodiments, configurations, uses, and methods are contemplated.

For example, a garment comprising a support garment panel is configured to be attached to an item of clothing worn by a person is contemplated. In one embodiment, the support garment panel includes a top portion having a fold line that divides the support garment panel into an inner panel and an outer panel. The inner panel and the outer panel are symmetrical. The support garment panel also includes a first region in the inner panel and the outer panel configured to be attached to a perimeter of a first armhole of the item of clothing. The support garment panel also includes a second region in the inner panel and the outer panel configured to be attached to a perimeter of a second armhole of the item of clothing. The support garment panel further includes a bottom portion configured to be attached to a waistline of the item of clothing.

The support garment panel may be made of breathable fabric. The fabric can breathable by way of being made of a mesh material. The support garment panel may be made of cotton, wool, silk, linen, synthetics, blends and combinations thereof. The support garment panel is made of elastic fabric. Elastic fabric has flexibility or elasticity allow the material to stretch and to have elastic properties. Material such as latex fabric can be used for example.

In one embodiment, the garment further comprises an elastic band at the waistline that further controls expansion and retraction of the support garment panel.

In one embodiment, the fold line has a length connecting the first region and the second region. The bottom portion may include a curvature having a length. The length of the curvature may be longer than the length of the fold line.

In accordance with principles of the present invention, a garment comprising an item of clothing to be worn by a person and a support garment panel attached to the item of clothing is contemplated. The item of clothing includes a first armhole and a second armhole. The support garment panel is attached to a perimeter of the first armhole and a perimeter of the second armhole to define a pocket between the support garment panel and the item of clothing. The pocket includes an opening for receiving an infant and a base for supporting the infant.

In one embodiment, the support garment panel is further attached to a natural waistline of the item of clothing (this position is further discussed below). The support garment panel is also attached to the item of clothing from the perimeter of the first armhole to the natural waistline and from the perimeter of the second armhole to the natural waistline. The natural waistline may comprise an elastic band that further controls expansion and retraction of the support garment panel. The elastic band keeps the infant in the pocket closer to the body of the person. The elastic band exerts an amount of elasticity on the support garment panel that allows the infant's head to roll away from the body of the person when the person is not holding the infant in the pocket during feeding.

In one embodiment, the support garment panel is sewn to the perimeter of the first armhole of the item of clothing and the perimeter of the second armhole of the item of clothing. The support garment panel is attached to the item of clothing with elasticity and the elasticity helps lifting the infant's head.

In one embodiment, the item of clothing includes a structure allowing the person to pull the item of clothing on one side for the first nursing position and on another side for the second nursing position.

In accordance with principles of the present invention, a nursing safety apparel is contemplated. The apparel comprises a receiving portion having a breathable fabric, a first attachment at a bottom section of the receiving portion adapted to be secured to a ribs section of a wearer, second and third attachments on opposing sides of the receiving portion and adapted to be supported by shoulders of the wearer, an opening formed at least partially by a top section of the receiving portion. The receiving portion is further adapted to allow the wearer to hold an infant in a nursing position and form into a shape of a safety support if the wearer loses hold of the infant.

In one embodiment, each of the second and third attachments comprises elastic material.

Each of the second and third attachments is adapted to be attached to a perimeter of a armhole.

An infant-nursing safety apparel can be provided that comprises

- a receiving portion comprising
  - a breathable fabric,
  - a first attachment at a bottom section of the receiving portion adapted to be positioned and held in place to a wearer's under bust (e.g., the fabric is attached or has an attachment to an elastic belt position at the wearer's under bust), second and third attachments on opposing sides of the receiving portion, wherein the second and third attachments are each adapted to be supported by corresponding shoulders of the wearer (e.g., attachments such seams or stitching is provides on the panel that are configured to attach to a wearer's armholes and be supported by the shoulders by way of the armholes); and an opening formed at least partially by a top section of the receiving portion (e.g., the top opening used to put the infant inside the pocket), wherein the receiving portion is further adapted to allow the wearer to hold an infant in a nursing position and adapted to change form into a shape of a safety support if the wearer removes support such as by losing hold of the infant (e.g., the infant sinks down into the bottom wider area of the pocket and the infant's head is supported by the elastic pull at the sides from the armholes).

The second and third attachments comprises elastic material such as a binding at the armhole.

The second and third attachments is adapted to be attached to a perimeter of an armhole.

The receiving portion is adapted to cause the infant's head to roll away from the wearer's chest.

The receiving portion when shaped into the safety support applies a supporting force to the infant's head by way of support from the second or third attachment depending on which side the infant is positioned.

The receiving portion is made of cotton, silk, linen, synthetics, blends, and combinations thereof.

The apparel comprising an elastic band adapted to be attached to the bottom portion of the receiving portion.

The apparel comprising an item of clothing having a first armhole, a second armhole, and an elastic band. The second attachment is adapted to be attached to a perimeter of the first armhole and the third attachment is adapted to be attached a perimeter of the second armhole. The elastic band is adapted to be attached to the bottom portion of the receiving portion. The receiving portion is adapted to be attached from a perimeter of the first armhole to the elastic band and from a perimeter of the armhole to the elastic band.

The receiving portion includes a support garment panel having an inner panel and an outer panel. The inner panel and the outer panel are symmetrical. Each of the second and third attachments includes a portion of the inner panel and the outer panel. The receiving portion includes a structure allowing the wearer to pull the receiving portion on one side for a first nursing position and on another side for a second nursing position.

BRIEF DESCRIPTION OF THE DRAWINGS

The nature and various advantages of the present invention (and other inventive aspects) will become more apparent upon consideration of the following detailed description, taken in conjunction with the accompanying drawings, in which like reference characters refer to like parts throughout, and in which.

DETAILED DESCRIPTION

Figure 1B:
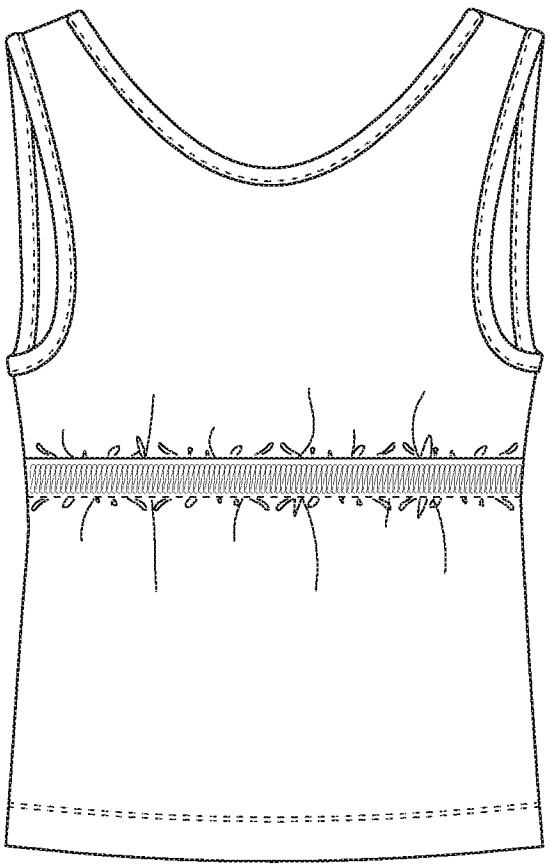
FIG. 1B depicts a back view of an illustrative infant nursing safety support garment in accordance with some embodiments of the invention.

Embodiments of the present invention are directed to a nursing garment that facilitates nursing and prevents an infant from accidentally falling from the caregiver while the caregiver nurses the infant. The nursing garment is adapted to form a pocket or envelope for receiving an infant. The pocket is designed to receive the infant for nursing the infant and for the infant to be supported by the arms of the wearer while the infant is in the pocket (e.g., during nursing). The caregiver holds the pocket and infant while nursing the infant. If the caregiver falls asleep or accidentally stops supporting the pocket and baby for any reason, the pocket provides a safety support to prevent the baby from falling to the ground or other surface. The pocket keeps the baby in the proximity of the caregiver such as on the caregiver's lap. The pocket is preferably made of a mesh, elastic material.

Embodiments of the present invention are particularly convenient or useful as a garment or "top" that is worn by a parent or caregiver while nursing the infant. However, it is not necessarily limited to being a garment in that other configurations are contemplated such as an apparel (e.g., a wearable accessory) that is worn over a separate top of the user. In discussion, for convenience, the term garment or apparel is used individually but it is understood that the discussion can be applicable to both.

A primary aspect of embodiments of the present invention relates to the safety mechanism provided by the garment that can hold an infant in a safe position when the infant "falls" due to a caregiver falling asleep or losing hold of the infant for some reason while the wearer is holding the infant in the garment or apparel. The second position can protect against injury from a fall and can protect against suffocation of the infant. Other advantages or benefits can also exist.

The material that forms the outside portion or wall of the garment can be made of a mesh material that is adapted to allow an infant to be able to breathe through the material such as by only breathing through the nose without difficulty if the infant's face is covered by the material (e.g., even if the infant is in a position where the infant's face is pressed against the material). The holes in the mesh will have sufficient openings to allow for air to flow through the material (e.g., even if in multiple layers) to the infant's nose. The material can be one single sheet that is made of a single contiguous fabric or can be multiple pieces of fabric. Preferably multiple sheets (e.g., two-ply) can form the outside portion.

The material can be loose in that it is adapted to be able to change shape from a first shape when it is draped over the wearer's chest to a second position when it receives an infant and has enough space to receive the infant. In this second position of the material or envelope, the material can remain loose such that there is additional room for the infant. For example, if desired, the infant could move his or her arms or legs without being constricted or pressured by the material to remain in a position. If an infant falls or moves into a safe position, the material (wall of envelope) and the configuration of the garment causes the infant to roll or rest on the infant's back (at the bottom of the pocket). In that state, the material is pulled or stretched such that the material has a small amount of looseness (or no looseness) (e.g., in the areas that are supporting or pulling on the infant to support the infant in the pocket). The nursing garment may be adapted to have an opening at the top for receiving the baby from the top and a bottom portion that is wider and deeper than the top portion (see the gathering at the bottom of the panel in the figures). The bottom portion (as shown in the figures) can have an attached to be connected to an elastic belt (e.g., an elastic belt held within the shirt). The bottom portion can be directed or indirectly attached to the belt. The relative shape at the bottom configures the panel (as implemented in the garment) to cause the infant (baby) to sink down to the wider bottom area when the wearer stops supporting the infant in the pocket. This can be a controlled "fall" into a safety position and the movement of the infant down, sinking down, can be by a slight amount. The infant would be resting on the infant's back in the pocket after the infant sinks down. Also, in this state, the material is adapted to support the infant's head (upright), e.g., because newborns do not have sufficient strength to hold their head upright. When the garment is in an empty state (no infant inside), the material may be bunched or gathered into the elastic belt or elastic mechanism. The elastic belt or elastic mechanism is positioned to be on the body (e.g., around the body) at the wearer's under bust (the area of the bra at the bottom of the bra and under the bust that wraps around the wearer for support), natural waistline, in an area of the ribcage below the nursing position, or in in general terms a body area that approximately aligns (laterally) with the bend of a wearer's arm when nursing. The elastic in this arrangement can help to fit the pocket and infant close to the body. For convenience, there terms are not repeatedly reused in the discussion but should be understood to be contemplated. This is also applicable, in general, to other terms where an alternative, equivalent, or variation of a term is mentioned in the discussion. The arrangement of the elastic belt or mechanism in the garment (around the body at the particular area) can sometime be referred to as an Empire waist.

In some embodiments, the garment is adapted to include an elastic material in the neckline of the garment. The garment can have a wide neckline in the back. The armholes provide significant or substantially all of the support for the panel and the infant when the infant is in the envelope without receiving support by the wearer. Attachments (e.g., seams) secure the panel to the armholes. A binding preferably is provided at the armhole for providing this support. A binding is an elastic material that is sewn to the armhole and connected to the panel by a seam/stitching. The figures as shown illustrate a binding at the armholes. As understood, this arrangement can be an elastic band that is wrapped by cloth and stitched along a seam (to enclose the elastic in the cloth). The seam can also be used to attach the attachment for the panel to the armhole (connect it to binding) and/or attach to the shirt. In the figures there is also a similar binding at the back of the neck while the front of the shirt is without such a binding as shown.

Figure 1A:
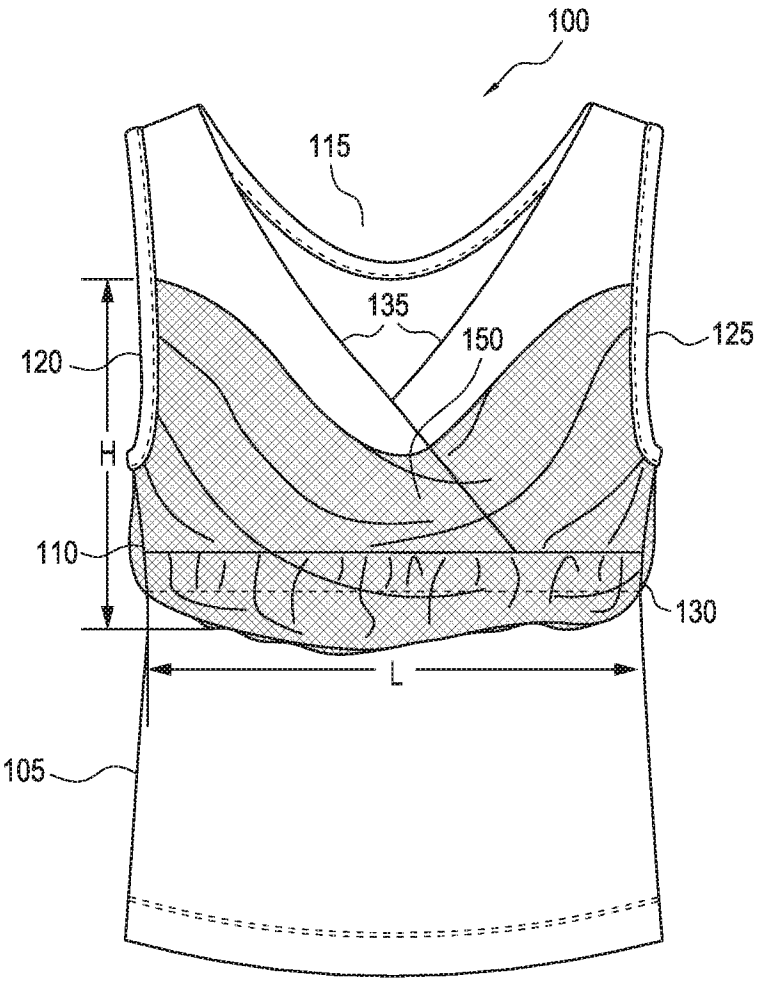
FIG. 1A depicts a front view of an illustrative infant nursing safety support garment in accordance with some embodiments of the invention.
Figure 1C:
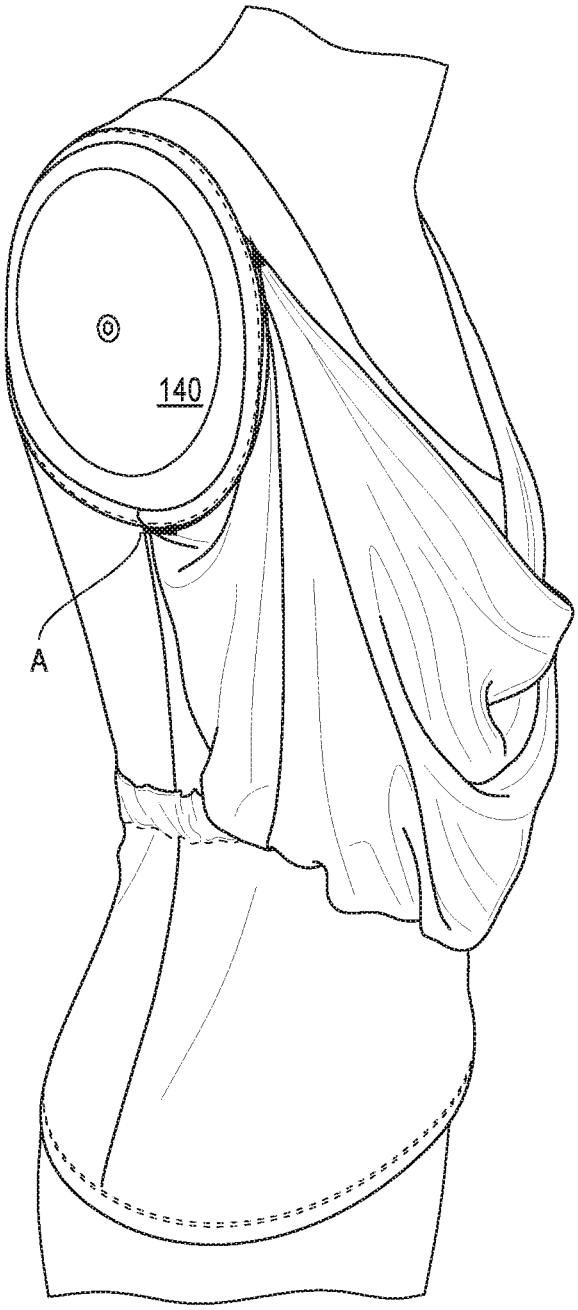
FIG. 1C depicts a side view of an illustrative infant nursing safety support garment in accordance with some embodiments of the invention.

FIGS. 1*a*-1*c* depict an illustrative infant support garment 100 in accordance with some embodiments of the invention. FIGS. 1*a*-1*c* depict a front view, back view, and side view of the garment 100, respectively. The garment 100 comprises an item of clothing 105 to be worn by a person and a support garment panel 110 attached to the item of clothing 105. The item of clothing 105 includes a neck hole 115, a first armhole 120, a second armhole 125, and an elastic band 130. The elastic band 130 is positioned at a location on the item of clothing 105 corresponding to a portion of the person's rib cage (a ribs section) the natural waistline of the person, or an area between the ribs section and the waistline. The item of clothing 105 includes a structure 135 allowing the person to pull the item of clothing 105 on one side for a first nursing position (e.g., position for nursing with left breast or position with the infant's head being closer to the second armhole) and on another side for a second nursing position (e.g., position for nursing with right breast or position with the infant's head being closer to the first armhole). The item of clothing 105 may be an undershirt, tank top, short or long sleeved shirt, or the like.

As generally understood, armholes, neck lines, or other apparel feature can be formed using fabric that is cut into shape, stitching, seams, piping, or other techniques.

The support garment panel 110 is attached to the perimeter of the first armhole 120 and the perimeter of the second armhole 125. The support garment panel 110 may be attached to only a portion 140 of the first armhole perimeter and only a portion of the second armhole perimeter (FIG. 1C). The portion 140 may extend from a location A under the person's armpit, to the front of the person's chest, and then toward the person's head. The portion 140 (or the attachment) may extend for a length to a location without reaching, touching, or covering the person's shoulder or the portion on the item of clothing that corresponds to the person's shoulder. In other words, the attachment is below the person's shoulders. The portion (or the attachment) on the other side has similar characteristics. Both portions may have the same length and height (e.g., the attachment to the first armhole and the attachment to the second armhole are leveled when viewed from the front). Other embodiments are contemplated. Also in some embodiments, the portions may have different length and/or height.

The support garment panel 110 is further attached to the item of clothing 105 via the elastic band 130 and from location A to the elastic band 130 (FIG. 1C, and the other side of the garment 100 has a similar attachment). The support garment panel 110 runs from one side (e.g., left side) of the garment 100 to the other side (e.g., right side) of the garment 100 to cover a portion of the garment 100 and is pulled upwards by the attachment to the armholes 120, 125. The garment 100 includes a pocket or receiving portion 150 defined by the support garment panel 110 and the item of clothing 105. The pocket 150 includes a top opening for receiving an infant and a base for supporting the infant. Preferably, the pocket 150 is adapted to receive the infant, inside the pocket with the infant in a lateral or sideway position (e.g., with the infant's on its back) as opposed in an upright position (e.g., with the infant's feet or legs entering the opening first and then the infant's torso or head-which is typical for carriers). The base include a portion (or bottom portion) of the support garment panel 110. The pocket 150 is preferably without a leg opening. The item of clothing 105, support garment panel 110, and pocket 150 are constructed to support the infant's weight, which typically ranges from about 5 lbs. to 12 lbs. In some embodiments, the item of clothing 105, support garment panel 110, and pocket 150 can be used to support weight larger than 12 lbs., depending on the construction and materials used.

In some embodiments, the pocket or the pocket with the infant is configured to be held by the person and allow nursing while being held. When the person stops supporting the infant, the pocket changes or expands into a shape of a safety support to prevent the infant from falling onto a surface or keeps the infant on the person's lap. In the shape of safety support, the pocket applies a supporting force to the infant's head by way of support from the attachment to the armhole 120 or the attachment to the armhole 125 depending on which side the infant is position. Armholes 120 and 125 are formed by sewing bindings (one for each armhole) wherein the binding contains an elastic such as an elastic band. The elastic band in the binding is attached to the panel and/or garment and provides support, an upward force, and comfort. The elastic provides comfort because the weight from the infant can pull on the armhole, which can be made comfortable from the elastic, and provide support and upward force to the panel (from the sides) and indirectly to the infant in the pocket. The elasticity should be sufficient to provide comfort and "pull" when the nursing garment is being used. As shown, the binding can be slightly larger than typical binding. Other techniques for providing elasticity at the armhole are also contemplated. While forming into the shape of the safety support, the process can allow the infant to roll on his or her back or directs the infant's head away from the person's chest (e.g., rolling from a position with the infant's head facing toward the person's chest to a position with the infant's head facing up, alighted with the infant's back), which can occur naturally due to gravity and positioning of the infant in the pocket.

The pocket can support the infant's head or neck without increasing the risk of suffocation in the safety position. When the infant is in the pocket 150, the infant is in contact with the item of clothing 105 and the support garment panel 110 (without contacting the person's skin unless the person pulls the item of clothing to one side).

The support garment panel 100 may be attached to the item of clothing 105 by sewing, stitching, seaming, bunching, gluing, taping, or other techniques. The attachment method may impart elasticity to the attachment or elasticity (or additional elasticity) to the sleeve, armhole, the item of clothing 105, and/or support garment panel 110. The item of clothing 105 and support garment panel 110 may be made of an elastic fabric. The item of clothing 105 and support garment panel 110 may be made of cotton, spandex, nylon, silk, linen, synthetics, blends and combinations thereof and be manufactured to be elastic if the material used is not already elastic.

The support garment panel 110 is preferably made of a loose breathable material such as a mesh to allow air flow so the infant can breathe if the infant's face is covered by the support garment panel 110. More preferably, the support garment panel 100 is made of a power mesh fabric. The support garment panel 100 may comprise nylon and spandex. For example, the support garment panel 100 may comprise approximately 90% of nylon and approximately 10% of spandex. The amount of spandex may have a range between about 8% and about 10%. The support garment panel 110 may be made more delicate compared to the item of clothing.

The support garment panel 110 may be configured to function as a screen to block from viewing the infant or the nursing of the infant. The support garment panel 100 is constructed and attached to the item of clothing 105 in a manner such that a portion of the support garment panel 100 sinks downward or towards the ground. For example, a portion of the support garment panel 110 may sink below the elastic band 130 before the infant is placed in the pocket. The support garment panel 100 may sink further when the infant is placed in the pocket (shape of safety support) and the support garment panel 100 may raise closer to the elastic band 130 when the infant is removed from the pocket. The support garment panel 100 has an elasticity or configuration that allows the person to pull the support garment panel 100 on one side for the first nursing position and on another side for the second nursing position. In one implementation, the support garment panel 100 is 16 inches (two-ply sheet of material that when laid flat is 32 inches) by 27 inches which is designed for babies that are 0-6 weeks old, which when positioned into the garment with the attachments has gathering or bunching at the bottom portion and would reflect different height and width as visually illustrated in the figures. The support garment panel 100 and the pocket 150 can have various structures, shapes, and dimensions depending on the physical size of the person.

The elastic band 130 can control the elasticity or expansion of the support garment panel 100 (and the item of clothing as well). The band 130 is attached to a bottom portion of the support garment panel 100. The elastic band 130 helps maintain or pull the pocket into a configuration. The band 130 can also keep the infant in the proximity of the person and control the position or movement of the infant in the pocket. For example, if the person stops supporting the infant in the pocket with his or her arms, the band 130 has a tendency to pull the support garment panel 100 such that the face of the infant does not roll toward to the body of the person (or that the face of the infant rolls away from the body of the person, e.g., to avoid suffocation). This feature avoids covering the infant's face with the person's body when the person stops supporting the infant in the pocket with his or her arms.

As discussed, the support garment panel 100 is preferably built to be held or supported by the person's arms when the infant is in the pocket. The support garment panel 100 also has an elasticity or strength to hold the infant to the body of the person when the support garment panel 100 is not supported by the person's arms. For example, upon placing the baby into the pocket, the person wearing the garment 100 places his or her arms under the pocket to support the baby or pocket. The person can nurse the baby while holding the baby or pocket. If the person inadvertently falls asleep and stops supporting the baby or pocket, the weight of the baby may cause the pocket to sink further but the pocket has an elasticity to keep the baby in proximity of the person (e.g., the person's lap) so the baby does not fall to the floor or other surface. In this situation, the weight of the baby does not impair or destroy the elasticity of the pocket, and the pocket can return to the position where it was before the baby is placed in the pocket after the baby is removed from the pocket. The pocket has enough strength to withstand the weight of the baby and minor movements of the baby, but may not have enough strength to withstand larger force such as the baby standing, walking, or jumping in the pocket (e.g., without ripping or being or deforming to an extent that is uncomfortable or not usable). The pocket is also designed to provide the needed elasticity or prevent the fall while the person is stationary and is not holding the pocket. For example, if the person is walking or running without holding the pocket with the baby in it, the pocket may lose elasticity, deform (e.g., cannot return to the position where it was before the baby is placed in the pocket), tear, or become detached from the item of clothing. In other words, the pocket may be made for nursing purpose only, and in particular, for preventing an infant falling while nursing in a stationary position. In the primary embodiments discussed herein, the pocket is not designed to have the strength to be a baby carrier, but rather a nursing garment with an added safety measure. As such, the pocket or the support garment panel can be lighter and/or thinner compared to a regular baby carrier and is generally cheaper to manufacture. Preferably, the fabric used for the pocket (e.g., a breathable latex material) is not strong enough to be used as a carrier.

Figure 2:
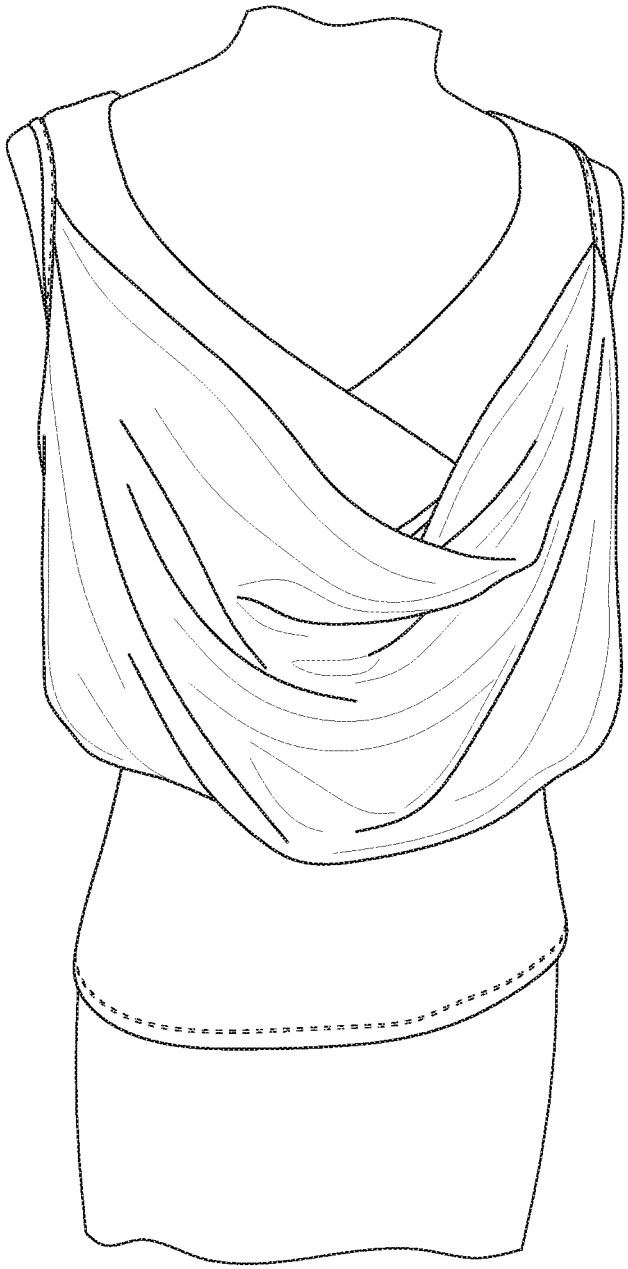
FIGS. 2-3 depict an illustrative infant nursing safety support garment worn by a mannequin to show the garment's dimension and position with respect to the mannequin in accordance with some embodiments of the invention.
Figure 3:
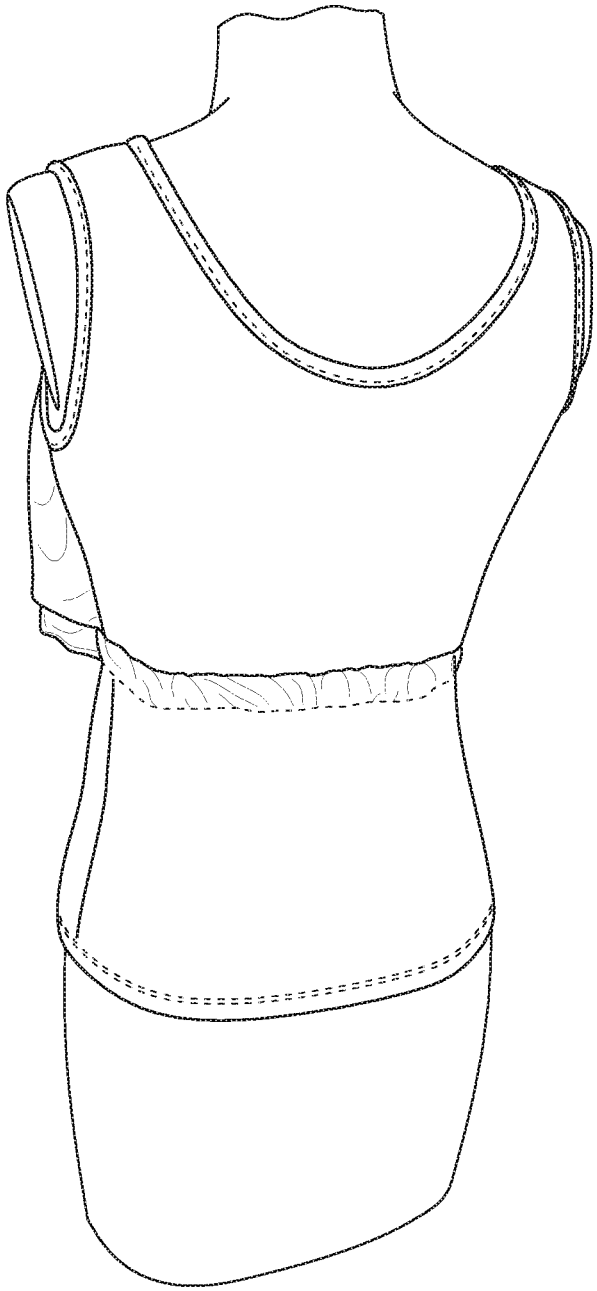
Figure 4:
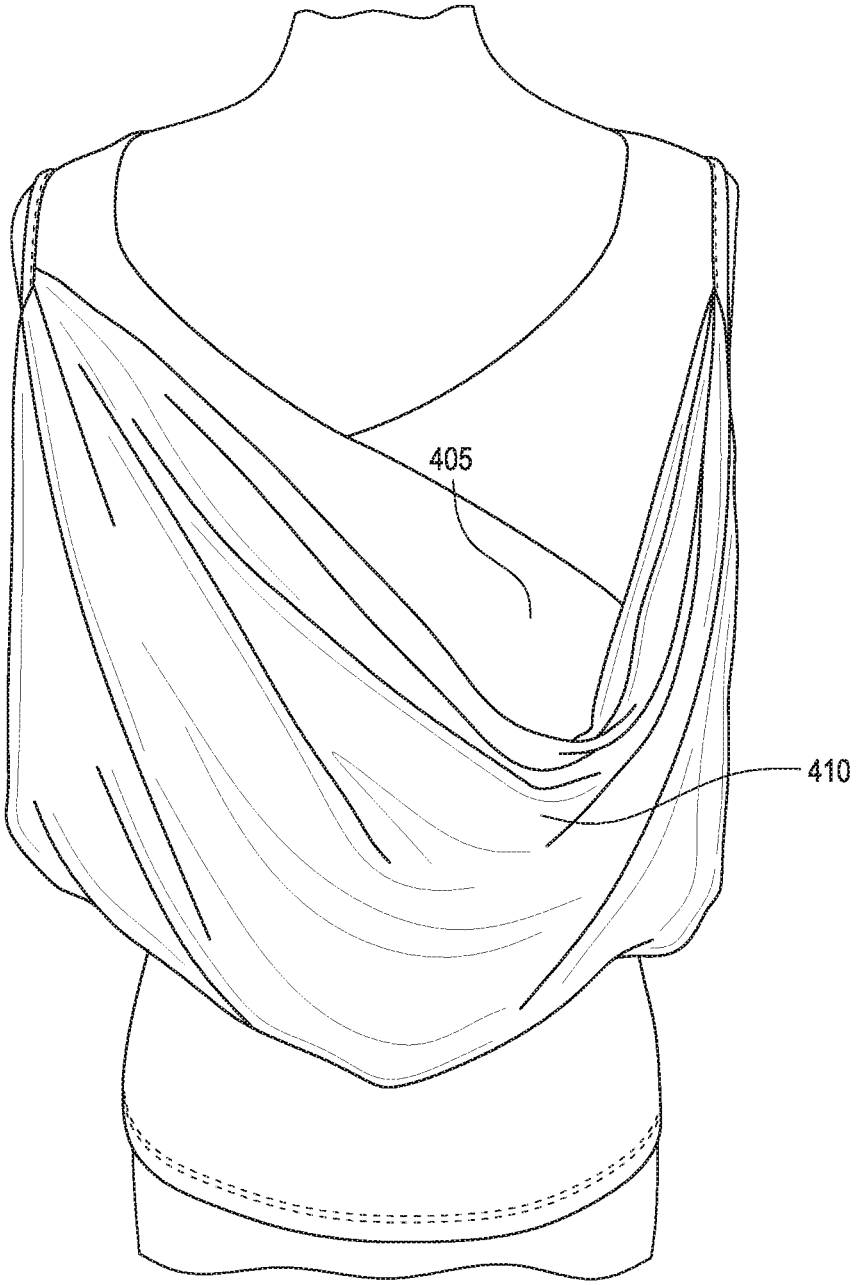
FIG. 4 depicts an illustrative item of clothing and an illustrative support garment panel that each allows the person to pull to one side for the first nursing position and to another side for the second nursing position in accordance with some embodiments of the invention.

FIGS. 2-3 depict an illustrative infant nursing support garment worn by a mannequin to show the garment's dimension and position with respect to the mannequin in accordance with some embodiments of the invention. FIG. 2 depicts a front view of the garment whereas FIG. 3 depicts a back view of the garment. These figures are used to illustrate the garment's approximate dimension and position when it is worn by a real person. FIG. 4 depicts an illustrative item of clothing 405 and an illustrative support garment panel 410 that each allows the person to pull to one side for the first nursing position and to another side for the second nursing position in accordance with some embodiments of the invention.

Figure 5:
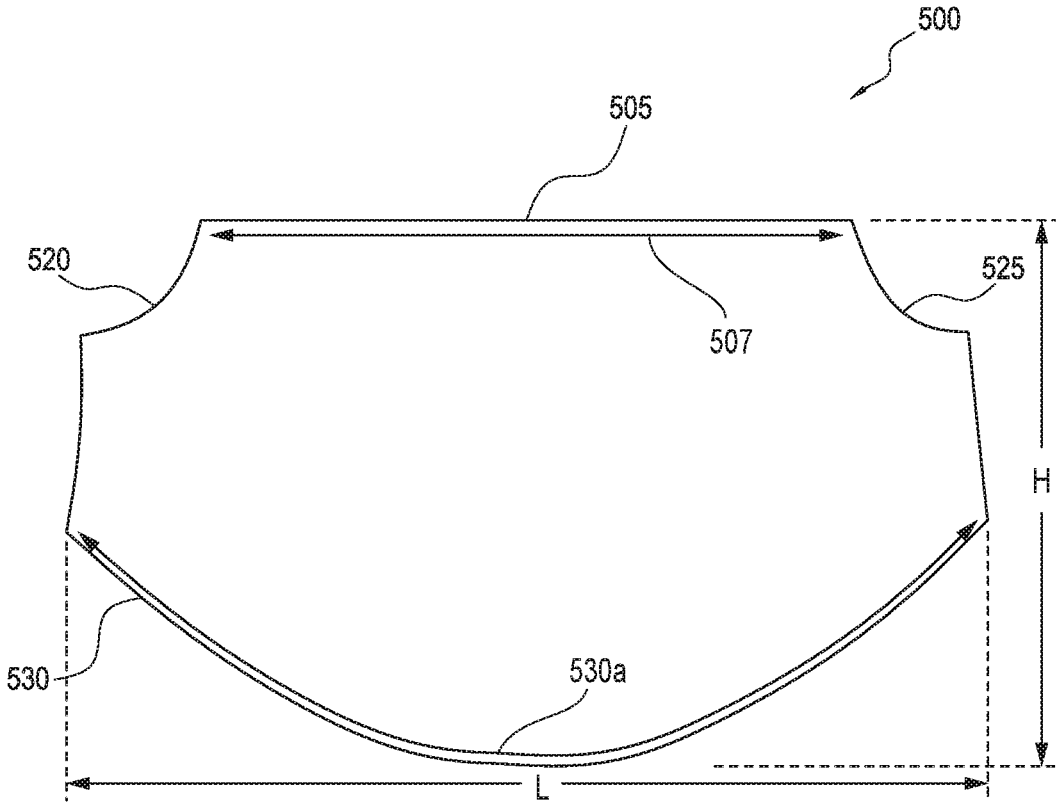
FIGS. 5-6 depict an illustrative support garment panel in accordance with some embodiments of the invention.
Figure 6:
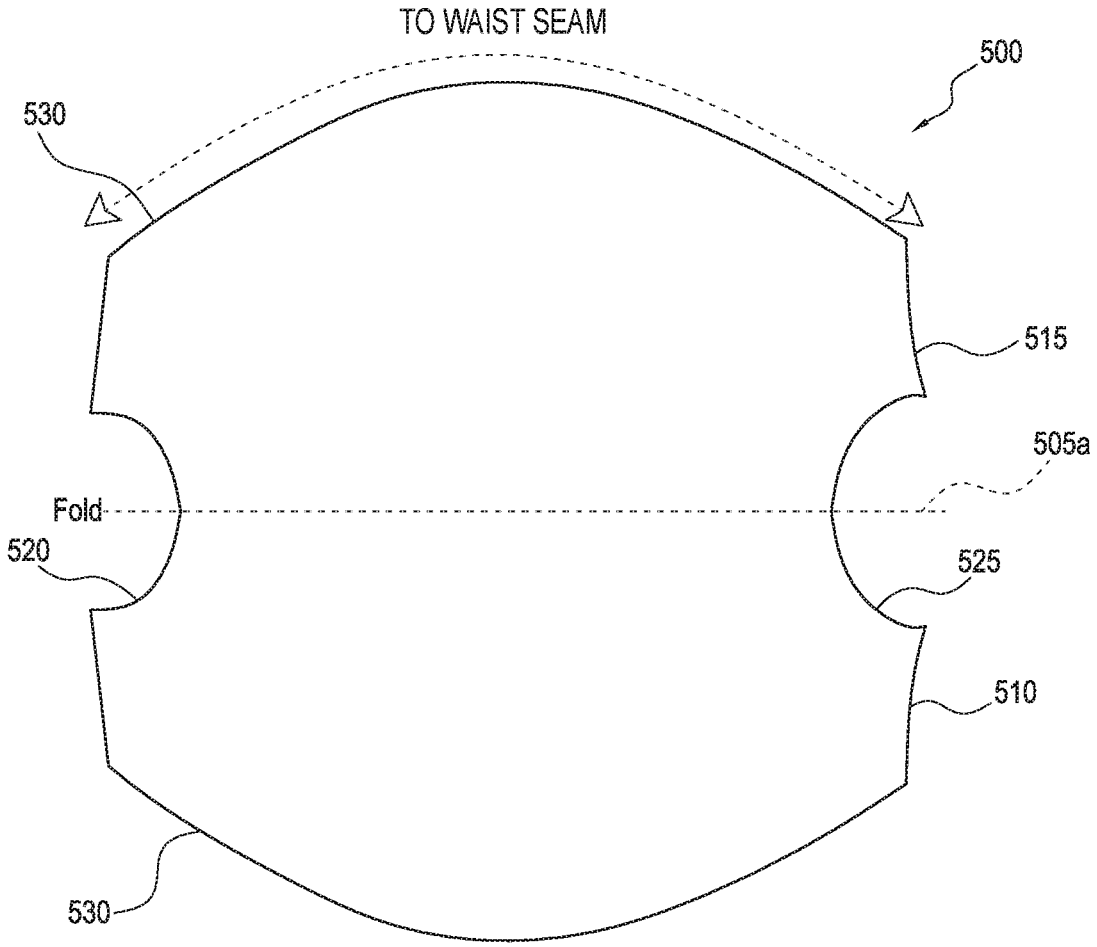

FIGS. 5-6 depict an illustrative support garment panel 500 in accordance with some embodiments of the invention. FIGS. 5-6 show a support garment panel 500 before it is attached to the garment 100. FIG. 5 shows the support garment panel 500 being folded and the configuration that would be attached to the garment 100. FIG. 6 shows the support garment panel 500 being unfolded. The panel 500 includes a top portion 505 having a fold line 505*a* that divides the support garment panel 500 into an inner panel 510 and an outer panel 515. The inner panel 510 and outer panel 515 are preferably symmetrical, but they may be asymmetrical or have different shapes and dimensions in some embodiments. The fold line 505*a* may be a straight line or in other configuration. The panel 500 also includes a first region 520 in the inner panel and the outer panel configured to be attached to the perimeter (or only a portion of the perimeter) of the first armhole of the item of clothing and a second region 525 in the inner panel and the outer panel configured to be attached to the perimeter (or only a portion of the perimeter) of the second armhole of the item of clothing. The first region 520 and the second region 520 each includes a curvature, and the curvature includes a center that aligns with the fold line 505*a*. A portion (or half) of the first region 520 is in the inner panel 510 and a portion (or the other half) of the first region 520 is in the outer panel 515. A portion (or half) of the second region 525 is in the inner panel 510 and a portion (or the other half) of the second region 525 is in the outer panel 515.

The panel 500 further includes a bottom portion 530 configured to be attached to a waistline of the item of clothing, a location on the item of clothing that corresponds to a portion of the person's rib cage, or an area in between. The bottom portion 530 may be attached to the elastic band. The top portion 505 and the regions 520, 525 define the opening for receiving the infant. The fold line 505*a* has a length 507 connecting the first region 520 and the second region 525. The bottom portion 530 includes a curvature having a length 530*a*. The length 530*a* of the curvature is longer than the length 507 of the fold line 505*a*. This longer length provides a wider area inside and at the bottom of the pocket compared to the size of the opening. In one embodiment, the panel 500 has a height (H) of about 27 inches and a length (L) of about 32 inches (one sheet laid flat before folding). Different sizes are contemplated such that the garment or pocket can adjust to corresponding sizes of the wearer or infant.

Although the support garment panel shown in the figures are attached to the armholes, the support garment panel may also be attached to other locations of the item of clothing in some embodiments, such as to the neck hole.

Figure 7:
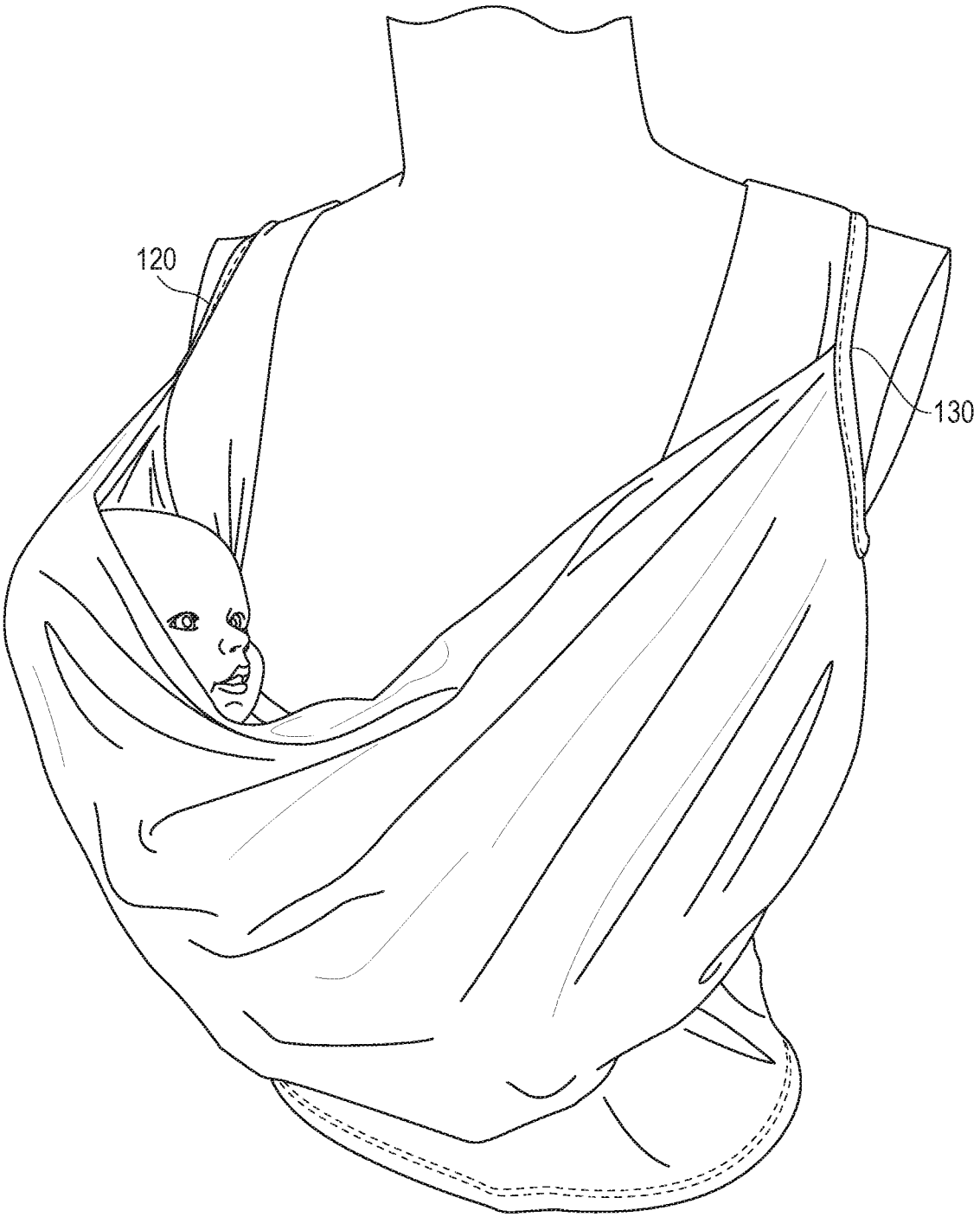
FIGS. 7-8 depict a baby in an illustrative infant support garment in accordance with some embodiments of the invention.
Figure 8:
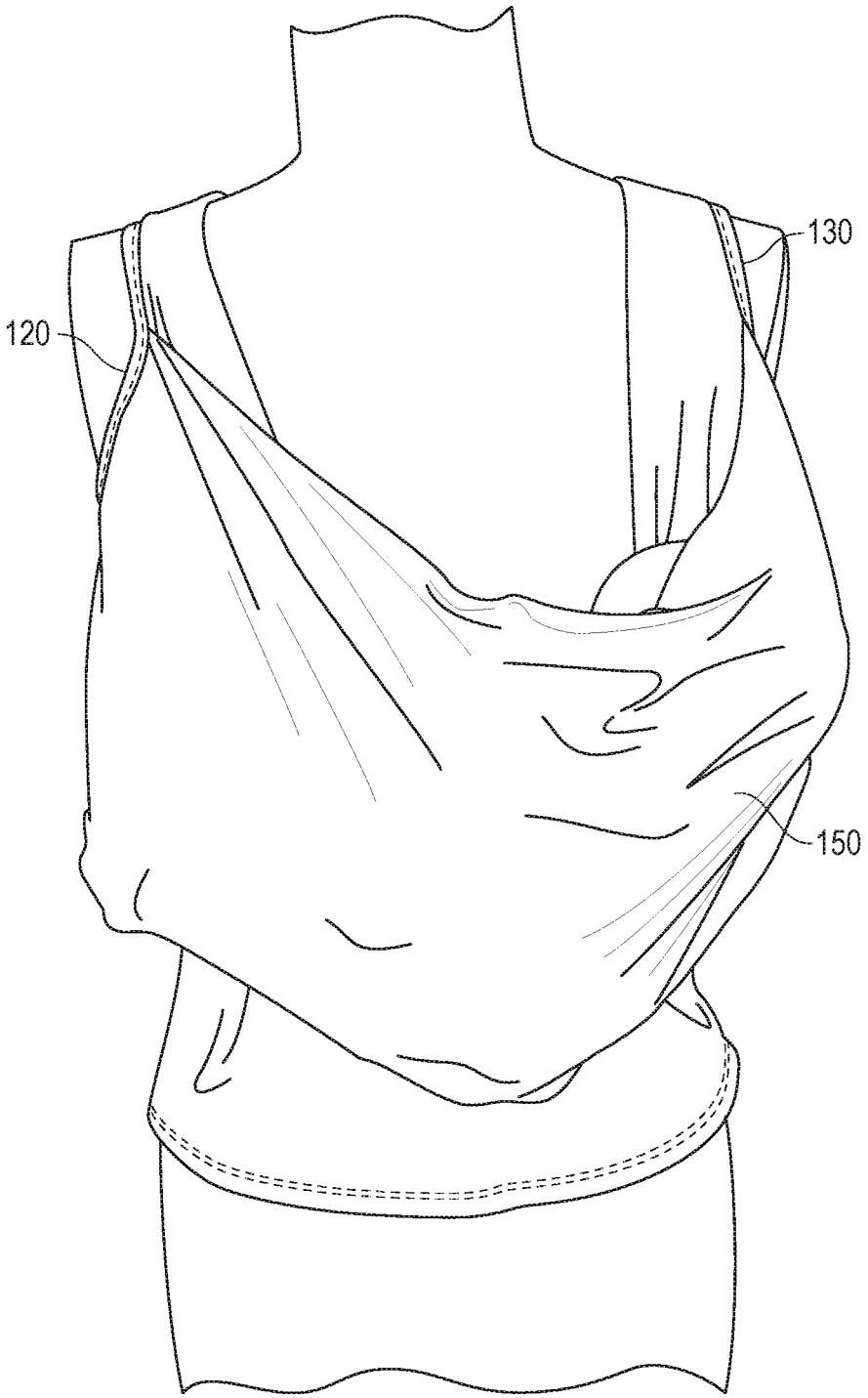

FIGS. 7-8 depict a baby in an illustrative infant support garment in accordance with some embodiments of the invention. In particularly, FIGS. 7-8 depict an infant support garment in the shape of safety support. When the person loses hold of the infant, the weight of the infant causes the pocket to change or expand into a shape of safety support to prevent the infant from falling onto a surface or keeps the infant in the proximity of the person. In the shape of safety support, the pocket applies a supporting force to the infant's head by way of support from the attachment to the armhole 120 or the attachment to the armhole 130 depending on which side the infant is positioned. FIG. 7 depicts that the infant's head is supported from the attachment to the armhole 120 whereas FIG. 8 depicts that the infant is supported from the attachment to the armhole 130.

The person wearing the item of clothing is a caregiver to the infant or an individual who would be nursing the infant. The person can be a male or female.

As designed, the infant support garment or the support garment panel can suitably accommodate maternal abdominal alterations in the immediate post-delivery phase including women who have had a C-Section.

The infant support garment shown in FIGS. 1-4 can be a one-piece garment or one integrated product (e.g., the garment is manufactured to be sold as one product). In some embodiments, the item of clothing and the support garment panel can be two separate garments or two garments purchased separately and then be attached together subsequently by the caregiver. The item of clothing can be typical clothing in the caregiver's wardrobe and the caregiver can attach and detach the support garment panel from the item of clothing. The caregiver can install the support garment panel by using a clip, pin, strap, buckle, or other mechanism.

In some embodiments, the caregiver can simply wear the support garment panel over an item of clothing he or she is wearing.

The term nursing in this disclosure can refer to breastfeeding or bottle feeding.

Infant or baby used in this disclosure can refer to an offspring who is only hours old to who is one year old or older (e.g., two year old). In some embodiments, the infant support garment and the support garment panel may also be used with a toddler or child who is two year older or older, depending their growth and weight and the construction and materials used for the infant support garment.

As shown in the figures, the shirt or other type of garment that includes the panel can have a side seam and the panel can be sewn into the side seam.

A nursing assistant has a construction that is at a lower level or is delicate (compared to carriers) such that it can sustain the weight of the infant for a short period of time without breaking or other impairment. It should be understood that the nursing assistant includes embodiments in which the assistant is configured or adapted to form a pocket that is taught or snug around the infant when the infant is in the pocket (e.g., the material for the pocket is not necessarily loose or lapping around infant or the user's arm when the infant is in the pocket). The nursing assistant is configured, as explained herein, to have room in the bottom middle of the pocket that allows the infant to move, which can be by a small amount, when support is removed (e.g., the care giver falls asleep). This room can exist from there being less elasticity pulling upward at that area and/or from the middle having a shape (using the panel) as described herein that has more space in that area. This naturally causes the infant to move into or slide into the bottom middle pocket (into the second state) where the "room" in the middle is used to receive the infant (when the support is removed).

As discussed, embodiments of the apparel include configuration in which the receiving portion is configured in the apparel to include room in a middle bottom portion that permits an infant to sink into that area while the infant's head is supported on the sides when the receiving portion is in the shape of the safety support.

As understood and discussed, the receiving portion can be loose when empty (without the infant). As understood and discussed, the receiving portion can be taught, loose, or combination thereof (e.g., loose in some areas) when an infant is in the pocket.

Exemplary infant support garment, item of clothing, and support garment panel are described for illustrative purposes. Further, since numerous modifications and changes will readily be apparent to those having ordinary skill in the art, it is not desired to limit the invention to the exact constructions as demonstrated in this disclosure. Accordingly, all suitable modifications and equivalents may be resorted to falling within the scope of the invention. Applications of the infant support garment, item of clothing, and support garment panel to other fields are also contemplated. The terms "may" or "can" are sometimes used for convenience to indicate that other variations are contemplated and should not be understood infer that the use of a direct verb such as "is" is intended to be limit the invention to a single embodiment.

It should be understood that combinations of described features are contemplated even if they are not described directly together or not in the same context. It should also be understood that embodiments can be with or without features as illustratively described herein.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An infant-nursing safety apparel comprising:

an item of clothing comprising a first armhole, a second armhole, and overlapping nursing panels, a waistline positioned along a bottom of the nursing panels;

a receiving portion comprising:

a first attachment at a bottom section of the receiving portion adapted to be positioned and held in place by attachment to the item of clothing along the waistline;

second and third attachments on opposing sides of the receiving portion, wherein the second and third attachments are each adapted to be attached along a portion of a perimeter of the first armhole and the second armhole, whereby when attached, the first armhole and the second armhole, along with the waistline, form a pocket adapted to receive an infant, and the first armhole and the second armhole support the infant from corresponding shoulders of a wearer; and an opening formed at least partially by a top section of the receiving portion, wherein the receiving portion is further adapted to allow the wearer to hold the infant in a nursing position, and wherein each of the first and second armhole comprises an elastic band, and the receiving portion is made of an elastic breathable material.

2. The apparel of claim 1, wherein each of the second and third attachments comprises elastic material.

3. The apparel of claim 1, wherein the receiving portion is made of cotton, nylon, spandex, silk, linen, synthetics, blends, or a combination thereof.

4. The apparel of claim 1, wherein the first attachment comprising another elastic band.

5. The apparel of claim 1, wherein the overlapping nursing panels comprise an inner panel and an outer panel that are symmetrical.

6. The apparel of claim 5, wherein each of the second and third attachments includes a portion of the inner panel and the outer panel.

7. The apparel of claim 1, wherein the receiving portion includes a structure allowing the wearer to pull the receiving portion on one side for a first nursing position and on another side for a second nursing position.

8. The apparel of claim 1, wherein the receiving portion is made of a mesh fabric.

9. The apparel of claim 1, wherein the item of clothing comprises a shirt, tank top, back panel, or sleeves.

* * * * *